US005425359A

United States Patent [19]

Liou

[11] Patent Number: 5,425,359

[45] Date of Patent: Jun. 20, 1995

[54] NOSE PLUG STRUCTURE WITH FILTER

[76] Inventor: Nan-Tien Liou, No. 25, Kai-Fa 6 Road, Pao-An Village, Jen-Te Shiang, Tainan Hsien, Taiwan, Prov. of China

[21] Appl. No.: 297,131

[22] Filed: Aug. 29, 1994

[51] Int. Cl.[6] ..... A62B 23/06

[52] U.S. Cl. ..... 128/206.11; 128/858; 128/207.13

[58] Field of Search ..... 128/858, 201.18, 201.23, 128/203.18, 203.22, 204.12, 206.11, 206.18, 206.28, 207.13, 207.18, 204.11

[56] References Cited

U.S. PATENT DOCUMENTS

| | | | |
|---|---|---|---|
| 1,278,342 | 9/1918 | Heimberg | 128/203.22 |
| 3,884,223 | 5/1975 | Keindl | 128/206.11 |
| 5,113,857 | 5/1992 | Dickerman | 128/206.11 |
| 5,117,820 | 6/1992 | Robitaille | 128/206.11 |

FOREIGN PATENT DOCUMENTS

| | | | |
|---|---|---|---|
| 2594033 | 8/1987 | France | 128/206.11 |
| 315091 | 5/1928 | United Kingdom | 128/206.11 |
| 2216806 | 10/1989 | United Kingdom | 128/206.11 |

*Primary Examiner*—Robert A. Hafer
*Assistant Examiner*—David J. Kenealy
*Attorney, Agent, or Firm*—Morton J. Rosenberg; David I. Klein

[57] ABSTRACT

A nose plug structure incorporating a filter is provided. The nose plug is integrally formed with a connecting piece and a pair of hollow columns formed on opposing sides of the connecting piece. In the middle of the connecting piece, a soft cover piece is positioned which can cover the exits of exhalation passages formed in each hollow column. An inner net, filter material, and a stop piece are arranged in order in each hollow column. An exhalation passage is formed in each column and leads to the exit located at the back of the connecting piece. When the plug is inserted in the nasal cavity, the inhaled air is cleaned as it passes through the stop piece, filter material and inner net. The exhaled air exhausts through the exhalation passages formed in the hollow columns, forcing the cover piece open.

2 Claims, 3 Drawing Sheets

NOSE PLUG STRUCTURE WITH FILTER

BACKGROUND OF THE INVENTION

1. Field of the Invention

This invention relates to a structure of a nose plug having a filter incorporated therein. In particular, this invention is directed to a nose plug with an air filter which is exquisite and can be placed in the nose.

2. Prior Art

In avoidance of inhalation of dirty air or dust into the respiratory tract, wearing of a gauze mask is, at present, one of the most popular and simplest methods used. However, it brings about the following troubles because of the limitations of the materials used and the shape of the structure:

1. A gauze mask is usually hung on the ears and thereby makes the ears uncomfortable after long use.

2. Since the gauze mask is made of a cotton cloth material, it is not very effective as a filter. The dust tends to attach to the mask's fibers and the gauze mask therefore needs to be changed or washed frequently.

3. Since the gauze mask is made of cotton cloth, it is prone to become wet with moisture exhaled by the user.

4. The wearing of a gauze mask hinders the speaking voice, such that it is not clear. It's really not convenient.

In view of the disadvantages of gauze masks, a nose plug structure having a filter incorporated therein has been developed to obviate those disadvantages. The object of the present invention being to solve the problems of discomfort, inefficiency, being prone to becoming wet, and causing a user's voice to become unclear.

SUMMARY OF THE INVENTION

In order to achieve the objects mentioned above, the invention provides an integrally shaped nose plug which comprises a connecting piece and a pair of shaped hollow columns on opposing sides thereof. In the middle of the connection piece there is provided a soft cover piece overlaying the exits of exhalation passages. The two columns are hollow with openings on both the front and back ends thereof. A permeable inner net, filter material, and a stop piece are assembled in order within the columns. Exhalation passages are formed in the columns.

DETAILED DESCRIPTION OF THE PREFERRED EMBODIMENT

Figure 1:
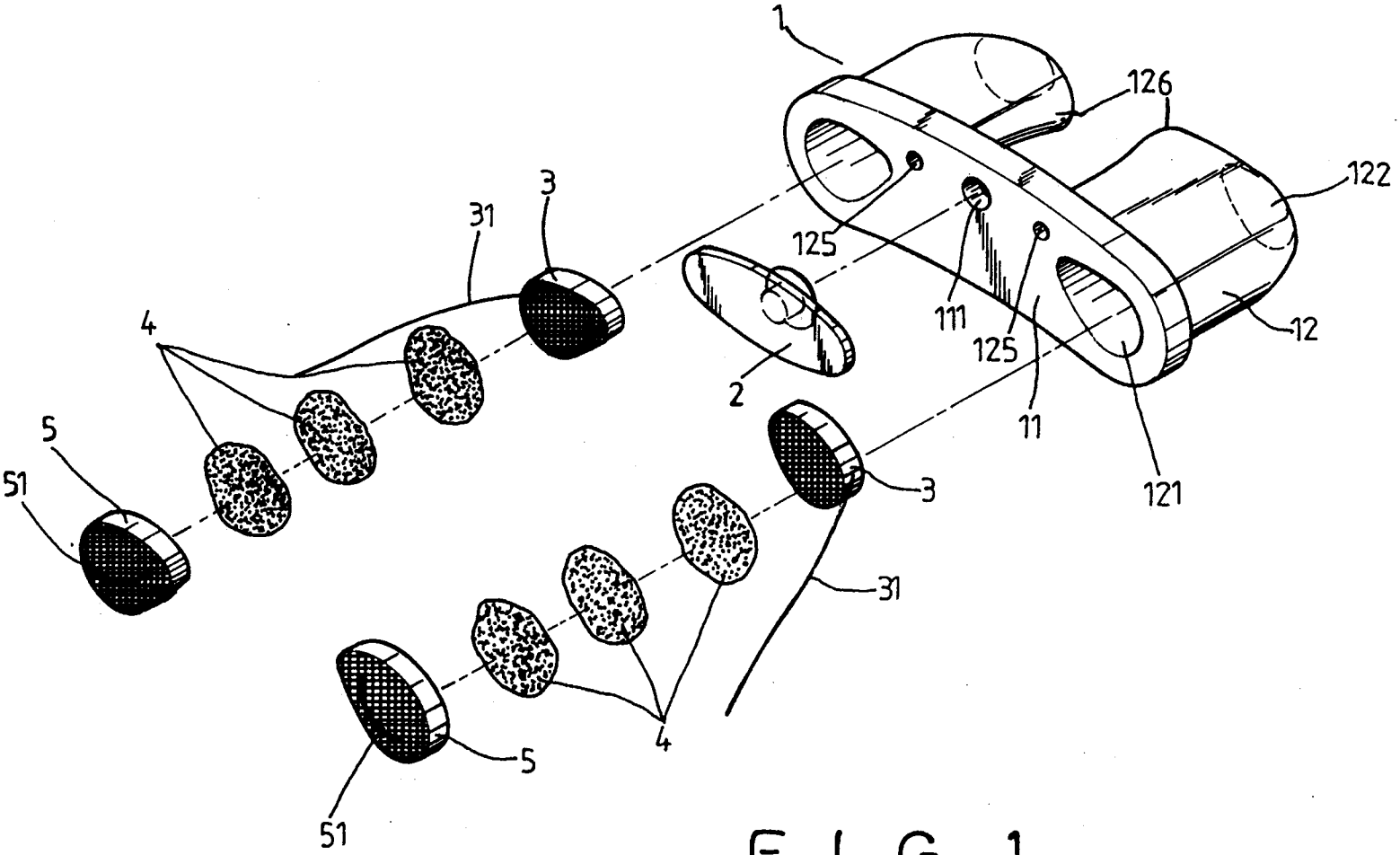
FIG. 1 is an exploded view of the present invention.
Figure 2:
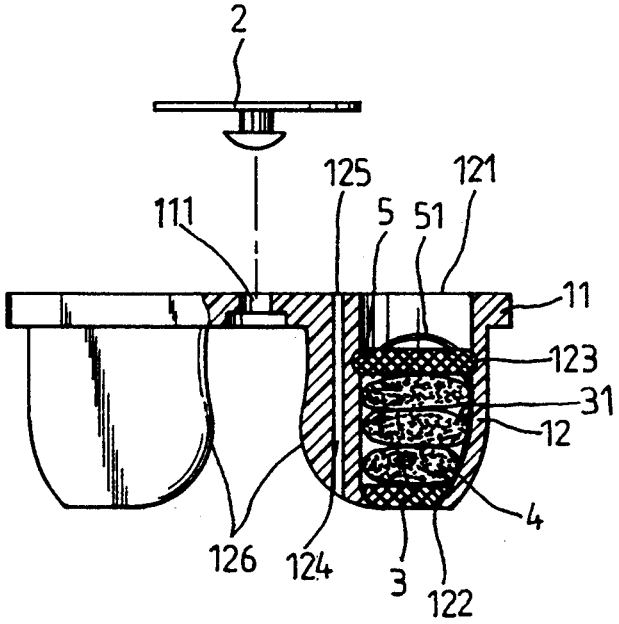
FIG. 2 is a combined sectional view of the present invention.

Reference is now made to FIGS. 1 and 2, wherein there is shown an integral structure comprising a connecting piece 11 and hollow columns 12 on opposing sides thereof. In the middle of the connection piece 11, a snag hole 111 is formed for clampingly retaining the soft cover piece 2. Openings 121,122 of a through passage are formed on both the front and back ends of each hollow column 12. A groove 123 is formed inside each hollow column 12 near the front opening. The outer contour of each hollow column 12 is formed in harmony with the inner contour of the nasal cavity. On the outside of each column 12, near the back opening 122, a gradually protruding portion 126 is formed. Each protruding portion 26 is positioned toward the nasal septum. When the nose plug 1 is inserted into the nasal cavity, it is secured to the nose cartilage to avoid inadvertent release. An exhalation passage 124 is formed in each of the hollow columns 12. The exhalation passage 124 leads to the connecting piece 11. The exit openings of each exhalation passage are positioned beneath a respective portion of the cover piece 2.

An inner net 3, filter material 4, and a permeable stop piece 5 are arranged in order inside each hollow column 12. An inner net 3 lies adjacent to the back opening 122 of each hollow column 12. On the side of the inner net 3 there is provided a pull string 31. The stop piece 5 is formed as a net, and has a pull ring 51 coupled to it. Each stop piece 5 is assembled in a hollow column 12 and is clamped in the groove 123.

Figure 4:
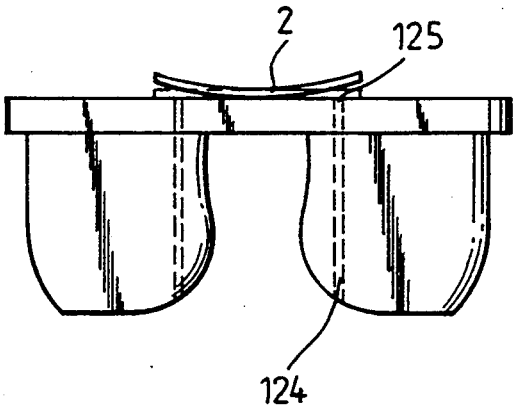
FIG. 4 is a schematic representation of the operation of the exhalation valve of the present invention.
Figure 3:
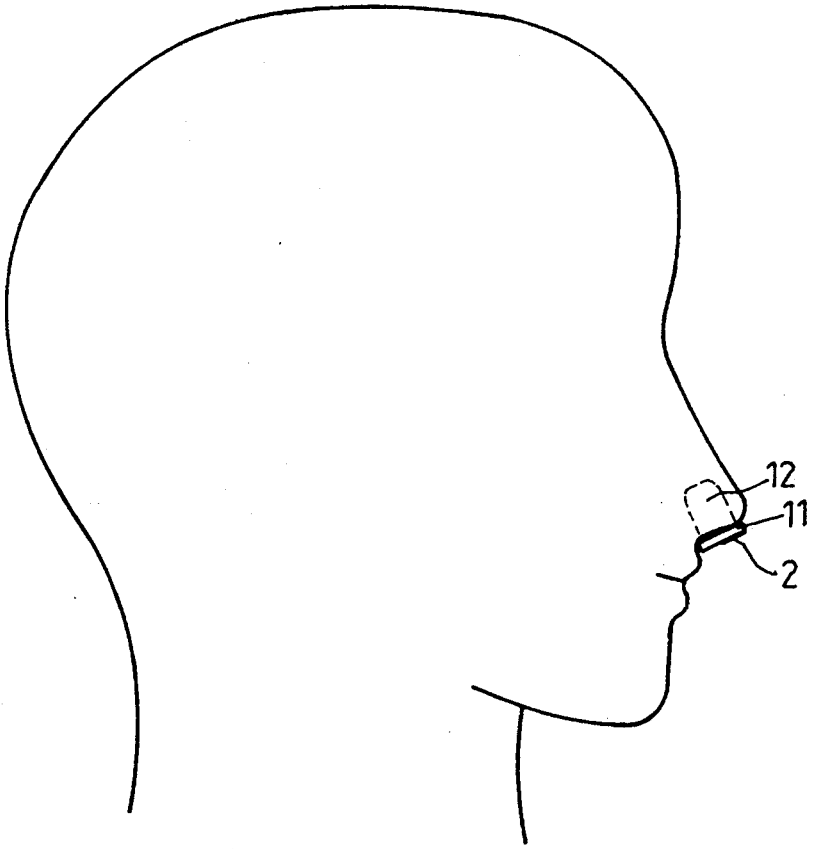
FIG. 3 is a schematic representation of the invention in use.

When the nose plug is put into use, as shown in FIG. 3, the two hollow columns 12 are inserted into respective nasal cavities. When the user breathes in, the unclean air comes in through the stop piece 5 and is cleaned by the filtering of the filter material 4. The air then passes through the trachea and into the lungs. During this period, the cover piece 2 stands against the connecting piece 11 and thereby blocks the exits 125 of the exhalation passages 124 to prevent unclean air from bypassing the filter material. The air exhaled by the user goes through the exhalation passages 124 formed in the two hollow columns 12, forcing respective portions of the cover piece 2 away from the exits 125, as shown in FIG. 4, and/or exhausts back through the filter elements in the hollow columns 12.

After the nose plug has been used for a period of time, dust will have attached on the inner net 3, filter material 4, and stop piece 5 in each hollow column 12, so that the filter effect of the plug is reduced. By pulling out the pull string 31 on the inner net 3, the filter material 4 and the inner net 3 are pulled out together. The used filter material 4 may then be changed, and the inner net 3 and stop piece 5 may be washed. Subsequently, they may be inserted into the respective hollow column 12 in order that the plug can be used again.

The nose plug 1 is of a design which is of small size, is convenient to wear and includes an effective filter. A user's voice is not made unclear by it. Since the nose plug 1 is formed from very soft material, one does not feel uncomfortable using it.

I claim:

1. An air filter nose plug, comprising:

a substantially planar connecting plate member having opposing front and rear surfaces, said connecting plate member having a centrally disposed first opening formed therethrough and a pair of second through openings formed adjacent to and on opposing sides of said first through opening, said connecting plate member having a pair of third through openings formed adjacent opposing ends thereof;

a flexible cover member coupled to said front surface of said connecting plate member through said first through opening, said cover member having a pair of opposing portions thereof respectively overlying said pair of second through openings for preventing air from entering said pair of second through openings;

a pair of longitudinally extended column members integrally formed with said connecting plate member and extending from a first end at said rear surface of said connecting plate member to a second end thereof, each of said column members being disposed adjacent a respective one of said opposing ends of said connecting plate member and having an external surface contour shaped to conform to a nasal passage, each of said column members having a first through bore extending between said first and second ends thereof and in aligned relation with a respective one of said pair of third through openings of said connecting plate, each of said column members having an annular groove formed in an internal wall surface of said first through bore adjacent said first end of said column member, each of said column members having a second through bore extending between said first and second ends thereof and in aligned relation with a respective one of said pair of second through openings of said connecting plate to define exhalation passages, wherein air exhaled through said exhalation passages displaces said pair of opposing portions of said cover member for exit through said second through openings;

a pair of air permeable inner net members, each of said pair of inner net members being disposed within a respective one of said pair of first through bores adjacent said second end thereof, each of said inner net members having a pull string extending therefrom;

a pair of air permeable stop members, each of said stop members being disposed within a respective one of said pair of first through bores adjacent said first end thereof and engaged within said annular groove, each of said inner net members having a pull ring coupled for facilitation of removal of said stop ring from said first through bore; and, means for filtering air disposed between each of said pair of inner net members and a respective one said pair of said stop members, whereby removal of said inner net member from said first through bore with said pull string removes said filtering means therewith.

2. The air filter nose plug as recited in claim 1 wherein each of said pair of column members includes a protrusion formed on an external surface adjacent said second end thereof and directed toward the other of said pair of column members for securement of said nose plug within each of a user's nasal cavities.

* * * * *